US006133210A

United States Patent [19]

Tipton

[11] Patent Number: 6,133,210

[45] Date of Patent: Oct. 17, 2000

[54] HOMOGENEOUS ADDITIVE CONCENTRATES FOR PREPARING LUBRICATING OIL COMPOSITIONS

[75] Inventor: Craig D. Tipton, Perry, Ohio

[73] Assignee: The Lubrizol Corporation, Wickliffe, Ohio

[21] Appl. No.: 09/109,891

[22] Filed: Jun. 30, 1998

[51] Int. Cl.[7] ..... C10M 145/02; C10M 161/00

[52] U.S. Cl. ..... 508/469; 508/470; 508/472; 508/542

[58] Field of Search ..... 508/469, 470, 508/542, 472

[56] References Cited

U.S. PATENT DOCUMENTS

| | | | |
|---|---|---|---|
| 3,702,300 | 11/1972 | Coleman | 252/51.5 A |
| 4,146,492 | 3/1979 | Cusano et al. | 252/56 R |
| 4,194,985 | 3/1980 | Coleman | 252/51.5 A |
| 4,374,034 | 2/1983 | Coleman | 252/51.5 A |
| 4,867,894 | 9/1989 | Pennewiss et al. | 252/56 R |
| 5,157,088 | 10/1992 | Dishong et al. | 525/327.6 |
| 5,620,948 | 4/1997 | Tipton | 508/159 |
| 5,641,732 | 6/1997 | Bloch et al. | 508/232 |
| 5,641,733 | 6/1997 | Bloch et al. | 508/469 |
| 5,646,099 | 7/1997 | Watts et al. | 508/469 |
| 5,707,943 | 1/1998 | Covitch | 508/469 |
| 5,763,374 | 6/1998 | Sakai et al. | 508/469 |
| 5,807,815 | 9/1998 | Alexander | 508/469 |
| 5,866,519 | 2/1999 | Watts et al. | 508/469 |

*Primary Examiner*—Jacqueline V. Howard

*Attorney, Agent, or Firm*—Joseph P. Fischer; David M. Shold

[57] ABSTRACT

A homogeneous composition comprising (A) at least one polymeric carboxylic ester viscosity improver optionally containing nitrogen-containing groups, and (B) at least one hydrocarbyl group substituted ashless dispersant wherein the hydrocarbyl group has $M_n$ ranging from about 200 to about 800, and the weight ratio of (A):(B) ranges from about 3:1 to about 1:3, where in one embodiment, the polymeric carboxylic ester viscosity improver is (1) a polyacrylate ester copolymer, optionally containing nitrogen containing groups, containing from 2 to about 30 carbon atoms in the ester group and having $M_n$ ranging from about 10,000 to about 150,000, and in another embodiment, the polymeric carboxylic ester viscosity improver is (2) an esterified carboxy-containing interpolymer, having RSV ranging from about 0.05 to about 0.35 before esterification, optionally neutralized with an amine, said interpolymer derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms.

28 Claims, No Drawings

HOMOGENEOUS ADDITIVE CONCENTRATES FOR PREPARING LUBRICATING OIL COMPOSITIONS

FIELD OF THE INVENTION

This invention relates to additive concentrates used to prepare lubricating oil compositions.

BACKGROUND OF THE INVENTION

Lubricating oil compositions are often prepared by blending additive concentrates containing one or more performance improving additives into an oil of lubricating viscosity. Additive concentrates are "packages" containing one or more performance improving additives. While it has been noted that from time to time chemical interactions take place between two or more components in additive concentrates, sometimes leading to unexpectedly improved performance, the usual reason for supplying additives in the form of additive concentrates is economics.

Often, the manufacturer of lubricating oil compositions does not manufacture the performance improving additives, or manufactures additives at a location remote from the plant where the lubricating oil composition is blended. Accordingly, it is usually necessary to transport the additives to the lubricating oil plant. Economics dictates that the additives be supplied in as concentrated a form as possible in order to keep shipping and storage costs to a minimum. It is also convenient to provide additives from a single package containing more than one component rather than to provide a number of additives individually.

At the lubricant blending site, convenience and economics are also considerations. It is convenient for the lubricant manufacturer to incorporate additives from a single package rather than individually. Moreover, when additives are supplied from a package, storage and supply facilities are reduced in number, resulting in improved economics.

As noted hereinabove, additives making up an additive concentrate may interact in a beneficial manner. From time-to-time, the interactions are adverse, for example, the interaction may result in diminished performance, or the additives may be physically incompatible, resulting in a non-homogeneous mixture. The present invention relates to the latter set of circumstances, i.e., where additives are mutually incompatible resulting in non-homogeneous mixtures.

Automatic transmission fluids (ATF) are well known in the art. In general, however, automatic transmission suppliers and manufacturers specify performance characteristics of the transmission operating with a fluid rather than fluid composition for use in the transmission. It is then up to fluid providers to formulate fluids which meet performance characteristics. Recently, performance requirements for ATF Service Fills have become more stringent with publication of DEXRON®-III ATF Specification by General Motors, GM 6297M, April, 1993. The Specification is available from General Motors, Material Engineering Transmissions, M/C 748 Ypsilanti, Mich. 48197 and is herein incorporated by reference.

In general, automatic transmission fluids comprise a base oil and additives. The base oil may be from natural sources, mineral and plant oils, and from synthetics and will be of the proper viscosity for their intended use. Additives are then incorporated into the base oil with those incorporated being dependent upon the properties that the fluid formulator is striving for. Additives for ATF include the following:

| | |
|---|---|
| anti-oxidants | viscosity improvers |
| corrosion inhibitors | friction modifiers |
| rust inhibitors | defoamers |
| anti-wear agents | pour point depressants |
| dispersants | |
| detergents | |
| seal swell agents | |

Formulations for ATFs and functional fluids containing some or all of the above additives in a select base oil are freely available in the patent literature. For instance, U.S. Pat. No. 4,209,587 to Koch lists lubricating/functional fluid compositions with various combinations of base oils and additives. U.S. Pat. No. 5,344,579 to Ohtani and Harley describes a friction modifier system for AT and cites additive components for ATFs and their typical ranges. The disclosure of both U.S. patents cited above are herein incorporated by reference. It must be noted that the lines between chemically active and inactive additives are not so distinct. Also, additives may well be multifunctional and are categorized above only for the sake of convenience.

One of the major requirements for automatic transmission fluids has been improved low temperature performance as demonstrated by a maximum Brookfield viscosity of 20,000 centipoise at −40° C. The viscosity modifier, which can comprise nearly 50 weight percent of the total additive system employed in an automatic transmission fluid can have a major impact on the low temperature performance. Such characteristics are also desirable in other applications such as in gear lubricants. The copolymers of this invention are also useful in many other lubricating oil compositions including, but not limited to engine oils, hydraulic oils, industrial oils, etc.

Recently, the trend has been in the direction of lubricants that retain their viscosity characteristics during use. For lubricating oils and particularly for mineral oil based lubricating compositions, improved viscosity characteristics are imparted by the use of viscosity improvers which arc usually polymeric materials. In order to maintain viscosity characteristics during use, a lubricating composition must contain a polymeric viscosity improver that resists shearing, that is, loss of molecular weight when the lubricant is subjected to high mechanical shear conditions.

Shear resistant polymers tend to be lower molecular weight polymers. In order to obtain desired viscosity improving characteristics, with these lower molecular weight, shear stable, polymeric viscosity improvers, they are generally used in increased amounts compared to higher molecular weight polymers. When these lower molecular weight viscosity improvers are combined with traditional, higher molecular weight additives, especially ashless dispersants, incompatibility and separation result.

Another requirement is that the automatic transmission fluid contains additives that prevent or reduce the deposition of sludge and varnish deposits.

Compositions that provide these desirable benefits frequently are additive concentrates that contain dispersants and viscosity improvers. Under certain circumstances, these ingredients are mutually incompatible, resulting in non-homogeneous compositions.

Dishong, et al in U.S. Pat. No. 5,157,088 teaches nitrogen-containing esters of carboxy-containing interpolymers wherein the interpolymer has inherent viscosity of from about 0.05 to about 0.30 may be used in lubricants and additive concentrates together with other known additives including, inter alia, dispersants.

Bloch, et al in U.S. Pat. No. 5,641,732 teaches partial synthetic automatic transmission fluids containing a mixed basestock containing synthetic oil and natural oil, a viscosity improver, including hydrocarbyl polymers and polyesters having moleculair weight ranging from 50,000 to less than 175,000, and any of a wide variety of friction modifiers, including reaction product of aliphatic hydrocarbon substituted carboxylic acids/anhydrides, where the substituent contains from 9 to 29 carbon atoms with polyamines.

Tipton in U.S. Pat. No. 5,620,948 teaches additive combinations containing a Mannich dispersant having base no in range of from about 45 to about 90, a boron compound, and an organic phosphorus acid, ester or derivative, and optionally, a thiocarbamate and a nitrogen containing ester of a carboxy containing interpolymer.

Pennewiss, et al in U.S. Pat. No. 4,867,894 describes polymethacrylate copolymers, optionally containing groups derived from nitrogen-containing monomers useful as pour point depressants in petroleum oils.

Cusano, et al in U.S. Pat. No. 4,146,492 describes a lubricating oil composition comprising a lubricating oil, a pour depressant polyalkylacrylate as described therein, a viscosity improving ethylene-propylene copolymer of molecular weight between about 10,000 and 150,000, and any of a wide variety of supplementary additives including ashless dispersants such as alkenyl succinimides, e.g., polyisobutylene (700–2000 m.w.) succinimide derived from tetraethylene pentamine.

Coleman in U.S. Pat. No. 4,374,034 describes compositions prepared by polymerizing under free radical conditions, at least one ethylenically unsaturated monomer in the presence of at least one oil-soluble dispersant characterized by the presence of an oil solubilizing group containing at least about 30 carbon atoms and a polar group bonded thereon.

It is a principal object of this invention to provide homogeneous additive concentrates.

It is a particular object of this invention to provide homogeneous additive concentrates comprising polymeric ester viscosity improvers and hydrocarbyl group substituted ashless dispersants.

Other objects will in part be obvious in view of this disclosure and will in part appear hereinafter.

SUMMARY OF THE INVENTION

The present invention is directed to a homogeneous composition comprising (A) at least one polymeric carboxylic ester viscosity improver optionally containing nitrogen-containing groups, and (B) at least one hydrocarbyl group substituted ashless dispersant wherein the hydrocarbyl group has $M_n$ ranging from about 200 to about 800, and the weight ratio of (A):(B) ranges from about 3:1 to about 1:3. In one embodiment, the polymeric carboxylic ester viscosity improver is (1) a polyacrylate ester copolymer, optionally containing nitrogen containing groups, containing from 2 to about 30 carbon atoms in the ester group and having $M_n$ ranging from about 10,000 to about 150,000. In another embodiment, the polymeric carboxylic ester viscosity improver is (2) an esterified carboxy-containing interpolymer, having RSV ranging from about 0.05 to about 0.35 before esterification, optionally neutralized with an amine, said interpolymer derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms.

In a further embodiment, when the additive concentrate comprises (A) polymeric viscosity improvers (1) or (2), the invention relates to the improvement wherein at least 50% by weight of the ashless dispersant is (B) a hydrocarbyl group substituted ashless dispersant wherein the hydrocarbyl group has $M_n$ ranging from about 200 to about 800 and the weight ratio of (A) to (B) ranges from about 3:1 to about 1:3.

In yet another embodiment, the invention relates to a method for improving the compatibility of additive concentrates comprising ashless dispersants and viscosity improvers (B). The invention is also directed to lubricating oil compositions comprising the additive concentrates of this invention.

DETAILED DESCRIPTION OF THE PREFERRED EMBODIMENTS

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms provided that they do not adversely affect reactivity or utility of the process or products of this invention.

In general, no more than about three non-hydrocarbon substituents or hetero atoms, and preferably no more than one, will be present for every 10 carbon atoms in the hydrocarbon or hydrocarbon based groups. Most preferably, the groups are purely hydrocarbon in nature, that is, they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated into a lubricating oil. For a further discussion of the terms oil soluble and dispersible, particularly "stably dispersible", see U.S. Pat. No. 4,320,019 which is expressly incorporated herein by reference for relevant teachings in this regard.

The expression "lower" is used throughout the specification and claims. As used herein to describe various groups, the expression "lower" is intended to mean groups containing no more than 7 carbon atoms, more often, no more than 4, frequently one or two carbon atoms.

It must be noted that as used in this specification and appended claims, the singular forms also include the plural unless the context clearly dictates otherwise. Thus the singular forms "a", "an", and "the" include the plural; for example "a monomer" includes mixtures of monomers of the same type. As another example the singular form "monomer" is intended to include both singular and plural unless the context clearly indicates otherwise.

In the context of this invention the term "copolymer" means a polymer derived from two or more different monomers. Thus, a polymer derived from a mixture of, for example, methyl-, butyl-, $C_{9-11}$-, and $C_{12-18}$-methacrylates, or a polymer having two or more distinct blocks, is a copolymer as defined herein. The copolymers of this invention also may contain units derived from nitrogen-containing monomers.

The expression "substantially inert" is used herein, usually in reference to diluents. When used in this context, "substantially inert" means the diluent is essentially inert with respect to any reactants or compositions of this invention, that is, it will not, under ordinary circumstances, undergo any significant reaction with any reactant or composition, nor will it interfere with any reaction or composition of this invention.

By homogeneous is meant a composition which is substantially uniform, with minimal separation of components. A small amount of separation is permissible, i.e., as sediment, usually constituting no more than about 1%, but most preferably, no more than about 0.5% by weight, even more often less than 0.1% by weight, of the composition. Gross separation of components is not acceptable.

The expression viscosity index (often abbreviated VI), is frequently used herein. Viscosity index is an empirical number indicating the degree of change in viscosity within a given temperature range. A high VI signifies an oil that displays a relatively small change in viscosity with temperature.

(A)(1) The Polyacrylate Ester Copolymer

In one embodiment, the polymeric carboxylic ester viscosity improver is (1) a polyacrylate ester copolymer, optionally containing nitrogen containing groups, containing from 2 to about 30 carbon atoms in the ester group.

The polyacrylate ester copolymers of this invention have a number average molecular weight ($M_n$) ranging from about 10,000 to about 150,000, more often from about 20,000, frequently from about 30,000, to about 100,000.

As used herein, the terms "acrylate" and "acrylamide" include the 2-alkyl acrylates and 2-alkyl acrylamides, particularly $C_{1-4}$ alkyl-, and especially, methacrylates and methacrylamides.

In one preferred embodiment, the polyacrylate ester copolymer comprises units derived from (A) from about 5% to about 75% by weight, preferably from about 30% to about 60% by weight of alkyl acrylate ester monomers containing from 1 to 11 carbon atoms in the alkyl group and (B) from about 25% to about 95% by weight, preferably from about 40% to about 70% by weight of alkyl acrylate ester monomers containing from 12 to about 24 carbon atoms in the alkyl group. In an especially preferred embodiment, the alkyl acrylate ester monomers comprise alkyl methacrylate esters.

In one particular embodiment, monomer (A) comprises at least 5% by weight of alkyl acrylate esters having from 4 to 11 carbon atoms in the alkyl group. In another embodiment, monomer (A) comprises from about 10% to about 40% by weight alkyl acrylate esters having from 1 to 4 carbon atoms in the alkyl group. In still another embodiment, monomer (A) comprises from about 60% to about 90% by weight of alkyl acrylate esters having from 9 to 11 carbon atoms in the alkyl group. In another embodiment, at least about 50 mole % of the esters contain at least 7 carbon atoms in the ester alkyl group.

As noted hereinabove, the polyacrylate ester copolymer may also contain nitrogen-containing groups. Such groups comprise from about 0.1% to about 45%, often to about 20% by weight, and in one embodiment from about 0.5% to about 5% by weight, especially from about 1.5% to about 2.5% by weight of nitrogen containing units derived from at least one nitrogen-containing monomer selected from the group consisting of vinyl substituted nitrogen heterocyclic monomers, dialkylaminoalkyl acrylate monomers, dialkylaminoalkyl acrylamide monomers, N-tertiary alkyl-acrylamides, and vinyl substituted amines. The nitrogen-containing groups may be incorporated by copolymerizing nitrogen-containing monomers with the acrylic monomers or by grafting the nitrogen-containing monomer onto a preformed acrylic polymer.

In one embodiment, the nitrogen-containing monomer is an N-vinyl substituted heterocyclic monomer. Examples of such monomers include N-vinyl imidazole, N-vinyl pyrrolidinone and N-vinyl caprolactam.

In another embodiment, the vinyl substituted heterocyclic monomer is vinyl pyridine.

In yet another embodiment, the nitrogen-containing monomer is a N,N-dialkylaminoalkyl acrylamide or acrylate wherein each alkyl or aminoalkyl group contains, independently, from 1 to about 8 carbon atoms.

In a further embodiment, the nitrogen-containing monomer is a tertiary-alkyl acrylamide, preferably tertiary butyl acrylamide.

Molecular weights of polymers are determined using well-known methods described in the literature. Examples of procedures for determining molecular weights are gel permeation chromatography (also known as size-exclusion chromatography) and vapor phase osmometry. These and other procedures are described in numerous publication including:

P. J. Flory, "Principles of Polymer Chemistry" Cornell University Press (1953), Chapter VII, pp 266–316, and "Macromolecules, an Introduction to Polymer Science", F. A. Bovey and F. H. Winslow, Editors, Academic Press (1979), pp 296–312.

W. W. Yau, J. J. Kirkland and D. D. Bly, "Modern Size Exclusion Liquid Chromatography", John Wiley and Sons, New York, 1979.

A measurement which is complementary to a polymer's molecular weight is the melt index (ASTM D-1238). Polymers of high melt index generally have low molecular weight, and vice versa. Mooney Viscosity (ASTM Procedure D-1646-87) relates indirectly to polymer molecular weight. All other factors being equal, as molecular weight of the polymer increases, so too does the Mooney viscosity.

ASTM Procedures D-1238 and D-1646-87 appear in Volumes 8 and 9, respectively, of the Annual Book of ASTM Standards, ASTM, Philadelphia, Pa., U.S.A.

A preferred method, and the method employed to determine the molecular weights of polymers as set forth herein, is gel permeation chromatography (GPC) employing polyacrylate standards.

The following examples illustrate several polyacrylate ester copolymers useful in the compositions of this invention. as well as means for preparing same.

EXAMPLE A-1

A container is charged with 35.1 parts methyl methacrylate, 136.5 parts $C_9$–$C_{11}$, methacrylate, 7.8 parts butyl methacrylate, 136.5 parts $C_{12}$–$C_{15}$ methacrylate, 70.2 parts $C_{16}$–$C_{18}$ methacrylate and 130 parts of a hydrotreated naphthenic oil (Risella G 07, Shell Germany) followed by stirring for 0.25 hours. A solution of 1.36 parts of 2,2-azobismethylbutyronitrile (VAZO-67, DuPont) in 2.7 parts toluene is added and stirred 0.1 hour. A reactor equipped with a stirrer, thermocouple reaching into the charged reaction mixture, $N_2$ inlet atop an addition funnel attached to a subsurface tube, and $H_2O$ condenser is charged with about 1/3 of the monomer-initiator solution. The remainder is placed in the addition funnel. With $N_2$ addition at 0.3 standard cubic feet per hour (SCFH) and stirring, the mixture is heated to 100° C. over 0.3 hour, heating is stopped and an exotherm to 131° C. over 0.1 hours is observed. The temperature begins to drop and after 2 minutes, at 131° C. dropwise addition of the remaining solution is begun. Addition time is 2 hours; 0.4 hours after the peak exothermic temperature, the temperature is 110° C. The temperature during addition is maintained at 110° C. The materials are cooled to 90° C. over 0.3 hour followed by addition of 0.25 part t-butyl peroctoate (Trigonox 21, AKZO) followed by addition of 0.98 parts N-vinylimidazole (NVI), both all at once. While maintaining 90° C., three additional increments, each of 0.98 parts NVI, are added at 0.25 hour intervals for a total of 4 additions. The mixture is held at 90° C. for 1.25 hours after the final NVI addition. An additional 0.13 parts Trigonox 21 is added and the materials are held at 90° C. for an additional 1 hour. An additional 80 parts Risella G 07 oil is added, the materials are heated to 150° C. and stripped at 40–50 millimeters (mm) mercury for 1 hour, collecting 3 parts distillate. The residue is filtered employing a diatomaceous earth filter aid at 110° C. The resulting product has $M_n$=58,400 and polydispersity ($M_w/M_n$)=2.90.

EXAMPLE A-2

A container is charged with 57.5 parts methyl methacrylate, 12.7 parts butyl methacrylate, 226.5 parts each of $C_{9-11}$ methacrylate and $C_{12-15}$ methacrylate, 114.8 parts $C_{16-18}$ methacrylate, 4.22 parts tert-dodecyl mercaptan, 164.6 parts 40N naphthenic oil (Shell Risella G-07) and 4.22 parts VAZO-67 dissolved in 8 parts toluene followed by mixing for 0.1 hour. One third of this solution is placed in a reactor equipped with stirrer, reflux condenser, thermocouple in solution and a $N_2$ inlet atop an addition funnel filled with the remaining 2/3 of the methacrylate solution. To the solution in the reactor are added 11.7 parts N-vinylimidazole, the contents of the flask are mixed for 0.1 hour then heated, under $N_2$, to 110° C. over 0.5 hour whereupon an exotherm to 140.3° C. is observed. After the exothermic rise in temperature, the temperature begins to drop. The remaining materials are then added dropwise over 2 hours during which time the temperature drops to 110° C. After the addition is completed, the materials are cooled to 90° C., 0.43 part Trigonox 21 is added, the materials are held at 90° C. for 1 hour, an additional 0.43 part Trigonox 21 is added followed by heating at 90° C. for an additional 2 hours. The materials are heated to 120° C. and stripped at 20 mm Hg fbr 0.1 hour, followed by filtration at 120° C. The filtrate has $M_w$=64,178 and $M_w/M_n$=3.4.

EXAMPLE A-3

A container is charged with 57.5 parts methyl methacrylate, 12.7 parts butyl methacrylate, 226.5 parts each of $C_{9-11}$ methacrylate and $C_{12-15}$ methacrylate, 114.8 parts $C_{16-18}$ methacrylate, 4.22 parts tert-dodecyl mercaptan and 164.4 parts 85 neutral (85N) paraffinic oil followed by mixing at ambient temperature for 0.2 hour. To this solution are added 4.22 parts VAZO-67 dissolved in 9 parts toluene followed by mixing for 0.1 hour. One third (273 parts) of this solution is placed in a reactor equipped with stirrer, reflux condenser, thermocouple in solution and a $N_2$ inlet atop an addition funnel filled with the remaining 2/3 (547 parts) of methacrylate solution. To the solution in the reactor are added 11.7 parts N-(3-(dimethylamino)propyl) methacrylamide, the materials are mixed for 0.2 hour then heated, under $N_2$, to 110° C. over 0.5 hour whereupon heating is discontinued and the temperature rises exothermically to 141° C. over 3 minutes. After the exothermic rise in temperature, the temperature begins to drop and after 1 minute, the temperature is 140° C. The remaining materials are then added dropwise over 2 hours during which time the temperature drops to 110° C. After the addition is completed, the materials are held at 110° C. for 0.5 hour, 0.43 part Trigonox 21 is added, the materials are held at 110° C. for 1 hour, 0.43 part Trigonox 21 are added followed by heating at 110° C. for an additional hour. The materials are heated to 125° C. and stripped at 20 mm Hg for 0.5 hour, collecting 9 parts distillate followed by filtration at 120° C. The filtrate has $M_w$=80,630 and $M_w/M_n$=3.28.

Useful acrylic ester polymers are also described in U.S. Pat. No. 5,534,175 and WO94/18288, each of which is hereby expressly incorporated herein by reference for relevant disclosures of such polymers and methods for preparing same.

(A)(2) The Esterified Carboxy-Containing Interpolymer

In another embodiment, the polymeric carboxylic ester viscosity improver is (2) an esterified carboxy-containing interpolymer, having RSV ranging from about 0.05 to about 0.35 before esterification, optionally neutralized with an amine, said interpolymer derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms.

An important element of the present invention is the molecular weight of the carboxy-containing interpolymer before esterification. Whenever reference is made in this application to RSV or reduced specific viscosity, the reference is to the interpolymer before it is esterified. For convenience, the molecular weight is expressed in terms of the "reduced specific viscosity" of the interpolymer which is a widely recognized means of expressing the molecular size of a polymeric substance. As used herein, the reduced specific viscosity (abbreviated RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 100 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the reduced viscosity, as well as its relationship to the average molecular weight of an interpolymer, appears in Paul J. Flory, *Principles of Polymer Chemistry,* (1953 Edition) pages 308 et seq.; Mark, Bikales,, Overberger and Menges, Eds., *Encyclopedia of Polymer Science and Engineering,* 2nd ed., Wiley Interscience (1988), V. 14, pp 463–465; and F. W. Billmeyer, *Textbook of Polymer Science,* Wiley Publishing (1962), pp 79–85.

The Interpolymer

The carboxy-containing interpolymers useful in preparing the esters useful in the invention are copolymers, terpolymers, and other interpolymers of (i) at least one aliphatic olefin monomer or vinyl aromatic monomer, and (ii) at least one alpha, beta-unsaturated carboxylic acylating agent, typically a carboxylic acid or derivative thereof. The derivatives of the carboxylic acid are derivatives which are polymerizable with the olefin monomers or vinyl aromatic monomers (i), and as such may be the esters, especially lower alkyl esters, e.g., those containing from 2 to 7 carbon atoms in the ester alkyl group, especially 2 carbon atoms, halides and anhydrides of the acids. The molar ratio of (i) to (ii) ranges from about 1:2 to about 3:1, preferably about 1:1. The carboxy-containing interpolymer is prepared by polymerizing an aliphatic olefin or vinyl aromatic monomer with the alpha, beta-unsaturated carboxylic acid or derivative thereof.

Mixtures of two or more compatible (i.e., nonreactive to one another) interpolymers which are separately prepared are contemplated herein for use in the esterification reaction, if each has a RSV as above described. Thus, as used herein, and in the appended claims, the terminology "interpolymer" refers to either one separately prepared interpolymer or a mixture of two or more of such interpolymers. A separately prepared interpolymer is one in which the reactants and/or reaction conditions are different from the preparation of another interpolymer.

While interpolymers having RSV from about 0.05 to about 0.35 are contemplated in the present invention, the preferred interpolymers are those having RSV of from about 0.08, often from 0.12 or 0.2 to about 0.3, often to 0.25. In another embodiment, the RSV ranges from about 0.05 to about 0.25, in still another embodiment, from about 0.08 to about 0.15. Interpolymers having RSV of from about 0.08 to about 0.25 or from about 0.10 to about 0.2 are particularly useful.

Aliphatic Olefins

Suitable aliphatic olefin monomers that are useful in the preparation of the interpolymers of the invention are mono-olefins of about 2 to about 30 carbon atoms. Included in this group are internal olefins (i.e., wherein the olefinic unsaturation is not in the "1" or alpha position) and mono-1-olefins or alpha-olefins. Alpha olefins are preferred. Illustrative olefins include ethylene, propylene, 1-butene, isobutene, 2-methyl-1-butene, 1-hexene, 1-dodecene, 1-hexadecene, 1-heneicosene, 1-docosene, 1-tetracosene, 1-hexacosene, 1-nonacosene, etc. Commercially available alpha-olefins can also be used. Exemplary alpha-olefin mixtures include $C_{15-18}$ alpha-olefins, $C_{12-16}$alpha-olefins, $C_{14-16}$ alpha-olefins, $C_{14-18}$ alpha-olefins, $C_{16-18}$ alhpa-olefins, $C_{16-20}$ alpha-olefins, $C_{22-28}$ alpha-olefins, etc. Additionally $C_{30}$+ alpha-olefin fractions such as those available from Conoco, Inc. can be used. Preferred olefin monomers include ethylene, propylene and 1-butene.

The mono-olefins can be derived from the cracking of paraffin wax. The wax cracking process yields both even and odd number $C_{6-20}$ liquid olefins of which 85 to 90% are straight chain 1-olefins. The balance of the cracked wax olefins is made up of internal olefins, branched olefins, diolefins, aromatics and impurities. Distillation of the $C_{6-20}$ liquid olefins obtained from the wax cracking process yields fractions (e.g., $C_{15-18}$ alpha-olefins) which are useful in preparing the interpolymers of this invention.

Other mono-olefins can be derived from the ethylene chain growth process. This process yields even numbered straight chain 1-olefins from a controlled Ziegler polymerization.

Other methods for preparing the mono-olefins include chlorination-dehydrochlorination of paraffin and catalytic dehydrogenation of paraffins.

The above procedures for the preparation of mono-olefins are well known to those of ordinary skill in the art and are described in detail under the heading "Olefins" in the Encyclopedia of Chemical Technology, Second Edition, Kirk and Othmer, Supplement, pages 632–657, Interscience Publishers, Div. of John Wiley and Son, 1971, which is hereby incorporated by reference for its relevant disclosures pertaining to methods for preparing mono-olefins.

Vinyl Aromatic Monomers

Suitable vinyl aromatic monomers which can be polymerized with the alpha, beta-unsaturated acylating agents include styrene and the substituted styrenes although other vinyl aromatic monomers can also be used. The substituted styrenes include styrenes that have halo-, amino-, alkoxy-, carboxy-,hydroxy-, sulfonyl-, hydrocarbyl- wherein the hydrocarbyl group has from 1 to about 12 carbon atoms and other substituents. Exemplary of the hydrocarbyl-substituted styrenes are alpha-methylstyrene, para-tert-butylstyrene, alpha-ethylstyrene, and para-lower alkoxy styrene. Mixtures of two or more vinyl aromatic monomers can be used. Styrene is preferred.

Alpha Beta-Unsaturated Acylating Agent

Suitable alpha, beta-unsaturated acylating agents useful in the preparation of the interpolymers are represented by carboxylic acids, anhydrides, halides, or lower alkyl esters and acid-esters thereof. These include mono-carboxylic acids (e.g., acrylic acid, methacrylic acid, etc., anhydrides and lower alkyl esters thereof, as well as dicarboxylic acids, anhydrides and lower alkyl esters thereof wherein a carbon-to-carbon double bond is in an alpha,beta-position to at least one of the carboxy functions (e.g., itaconic acid, anhydride or lower esters thereof, α-methylene glutaric acid or esters thereof,) and preferably in an alpha, beta-position to both of the carboxy functions of the alpha, beta-dicarboxylic acid, anhydride or the lower alkyl ester thereof (e.g., maleic acid or anhydride, fimaric acid, or lower alkyl esters thereof). Normally, the carboxy functions of these compounds will be separated by up to about 4 carbon atoms, preferably about 2 carbon atoms.

A class of preferred alpha,beta-unsaturated dicarboxylic acid, anhydrides or the lower alkyl esters thereof, includes those compounds corresponding to the formulae:

(I)

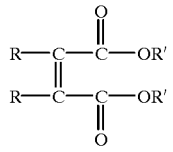

(II)

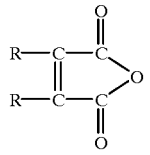

(including the geometric isomers thereof, i.e., cis and trans) wherein each R is independently hydrogen; halogen (e.g., chloro, bromo, or iodo); hydrocarbyl or halogen-substituted hydrocarbyl of up to about 8 carbon atoms, preferably alkyl, alkaryl or aryl; (preferably, at least one R is hydrogen, more preferably, both R are hydrogen); and each R' is independently hydrogen or lower alkyl of up to about 7 carbon atoms (e.g., methyl, ethyl, butyl or heptyl). These alpha, beta-unsaturated dicarboxylic acids, anhydrides or alkyl esters thereof contain a total carbon content of up to about 25 carbon atoms, normally up to about 15 carbon atoms. Examples include maleic acid or anhiydride; benzyl maleic anhydride; chloro maleic anhydride; heptyl maleate; itaconic acid or anhydride; ethyl fumarate; fumaric acid, mesaconic acid; ethyl isopropyl maleate; isopropyl fumarate; hexyl methyl maleate; phenyl maleic anhydride and the like. These and other alpha, beta-unsaturated dicarboxylic compounds are well known in the art. Maleic anhydride, maleic acid and fumaric acid and the lower alkyl esters thereof are preferred. Mixtures of two or more of any of these can also be used.

Alternatively, the (OR') group in the above formula may contain more than 7 carbon atoms, being derived from a mixture of alcohols, some containing over 7 carbon atoms, and in such instances, the ester group may remain attached to the carboxy group during and after formation of the interpolymer. This procedure provides a method of introducing the desirable ester groups initially, and eliminates the need to introduce the ester groups in a separate subsequent step.

In another preferred embodiment, the alpha,beta-unsaturated agent comprises a mixture of two or more components. Thus, interpolymers prepared from reaction mixtures comprising 2 or more, usually up to 4, preferably 2, different alpha-beta unsaturated acylating agents are contemplated. A non-limiting example might be a mixture of maleic acid or anhydride with esters of acrylic acids. Other mixtures are contemplated.

When the alpha,beta-unsaturated agent comprises a mixture of monomeric components, they may be present in any amounts relative to one another. However, it is preferred that one of the components is present in a major amount, i.e., more than 50 mole % of the mixture. In an especially preferred embodiment, the total amount of additional components is present in amounts ranging from about 0.005 to about 0.3 moles, per mole of major component, more often from about 0.01 to about 0.15 moles, preferably from about 0.03 to about 0.1 moles minor component per mole of major component.

Examples of preferred mixtures of acylating agents are, maleic acid or anhydride with esters of acrylic acids, especially esters of methacrylic acid. Preferred esters are lower alkyl esters. An especially preferred mixture of acylating agents is one containing maleic anhydride and lower alkyl esters of methacrylic acid. Especially preferred is a mixture of maleic anhydride and methyl or ethyl, preferably methyl, methacrylate.

Particularly preferred esters used in the compositions of this invention are those of interpolymers made by reacting maleic acid, or anhydride or the lower esters thereof with styrene. Of these particularly preferred interpolymers, those which are made of maleic anhydride and styrene and have a RSV in the range of about 0.05 to about 0.35, preferably about 0.08 to about 0.25, are especially useful. Of these latter preferred interpolymers, copolymers of maleic anhydride and styrene having a molar ratio of the maleic anhydride to styrene of about 1:1 are especially preferred. They can be prepared according to methods known in the art, as for example, free radical initiated (e.g., by benzoyl peroxide) solution polymerization. Examples of such suitable interpolymerization techniques are described in U.S. Pat. Nos. 2,938,016; 2,980,653; 3,085,994; 3,342,787; 3,418,292; 3,451,979; 3,536,461; 3,558,570; 3,702,300; 3,723,375; 3,933,761; 4,284,414, 4,604,221, and 5,707,943. These patents are incorporated herein by reference for their teaching of the preparation of suitable maleic anhydride and styrene containing interpolymers. Other preparative techniques are known in the art.

The carboxy-containing interpolymers may also be prepared using one or more additional interpolymerizable comonomers. The additional comonomer is present in relatively minor proportions. Generally, the total amount is less than about 0.3 mole, usually less than about 0.15 mole of additional comonomers for each mole of either the olefin or the alpha,beta-unsaturated carboxylic acylating agent. Examples of additional comonomers include acrylamides, acrylonitrile, vinyl pyrrolidinone, vinyl pyridine, vinyl ethers, and vinyl carboxylates. In one embodiment, the additional comonomers are vinyl ethers or vinyl carboxylates.

Vinyl ethers are represented by the formula $R_1$—CH═CH—$OR_2$ wherein each $R_1$ is hydrogen or a hydrocarbyl group having 1 to about 30, or to about 24, or to about 12 carbon atoms and $R_2$ is a hydrocarbyl group having 1 to about 30 carbon atoms, or to about 24, or to about 12. Examples of vinyl ethers include methyl vinyl ether, propyl vinyl ether, 2-ethylhexyl vinyl ether and the like.

The vinyl ester of a carboxylic acid may be represented by the formula $R_3$CH═CH—O(O)$CR_4$ wherein $R_3$ is a hydrogen or hydrocarbyl group having from 1 to about 30, or to 12 carbon atoms, or just hydrogen, and $R_4$ is a hydrocarbyl group having 1 to about 30, or to about 12, or to about 8. Examples of vinyl esters include vinyl acetate, vinyl 2-ethylhexanoate, vinyl butanoate, vinyl crotonate. Vinyl carboxylates include vinyl acetate, vinyl butanoate, etc.

The molecular weight (i.e., RSV) of such interpolymers can be adjusted to the range required in this invention, if necessary, according to conventional techniques, e.g., control of the reaction conditions.

Preferred interpolymers are prepared from a vinyl aromatic monomer and an aliphatic carboxylic acid or anhydride and esters thereof.

Preferably, the vinyl aromatic monomer is styrene or a substituted styrene (either ring substituted or substituted on the aliphatic —C═C group), most preferably, styrene.

Preferably, the aliphatic carboxylic acid or anhydride and esters thereof is at least one member selected from the group consisting of maleic acid or anhydride, itaconic acid or anhydride, fumaric acid, α-methylene glutaric acid, acrylic acid, methacrylic acid or an ester thereof.

In one preferred embodiment the interpolymer is derived from styrene and maleic anhydride. In another preferred embodiment the interpolymer is derived from styrene, maleic anhydride and methacrylic acid or an ester thereof.

In the latter preferred embodiment, the mole ratio of styrene:maleic anhydride:methacrylic acid or ester thereof ranges from about (1–3):(2–1):(0.01–0.3), preferably from about (1–2):(1.5–1):(0.01–0.03), more preferably from 1:1:(0.03–0.08), most preferably from 1:1:0.05.

As noted hereinabove, the esterified carboxy containing interpolymer may be neutralized with an amine having an average of from about 1 to about 1.5 primary or secondary amino groups, particularly those having an average of from 1 to about 1.1, and preferably one, primary or secondary amino groups. In one embodiment the amino compound is a polyamino compound having at least one mono-functional amino group. Such amino groups, when present in the esters of the present invention in the proportion stated above, enhance the dispersant properties of such esters in lubricant compositions and dispersability of additives for lubricant compositions.

The amines which are used to form carbonyl-amino group may be mono- or polyamines. To illustrate, the amine may be a monoaminie containing one primary or secondary amino group. Here the number of primary or secondary amino groups is 1. The amine may be a polyamine, wherein one amino group is primary or secondary and one or more are tertiary. Aminopropylmorpholine and dimethylaminopropyl amine are examples. The amine reactant may also be a mixture of these with one or more polyamines containing 2 or more primary or secondary amino groups, provided that the average number of primary or secondary amino groups in the mixture is no greater than about 1.5, preferably about 1.1, more preferably less than 1.05, often 1.

Examples of monoamines include aliphatic amines such as mono-, di- and tri-alkyl amines having alkyl groups containing from 1 to about 20 carbon atoms as well as cyclic monoamines.

In one embodiment, the amines are polyamines having an average of from 1 to about 1.1, preferably one, primary or secondary amino group, and at least one mono-functional amino group such as a tertiary-amino group or heterocyclic amino group. In one particular embodiment, the carbonyl-polyamino group is derived from a morpholine. Examples of morpholines include aminoethylmorpholine, aminopropylmorpholine, etc. For the most part, the amines are those which contain only one primary-amino or secondary-amino group and, preferably at least one tertiary-amino group. The tertiary amino group is preferably a heterocyclic amino group. In some instances polyamines may contain up to about 6 amino groups although, in most instances, they contain one primary-amino group and either one or two tertiary-amino groups. The polyamines may be aromatic or aliphatic amines and are preferably heterocyclic amines such as aminoalkyl-substituted morpholines, piperazines, pyridines, benzopyrroles, quinolines, pyrroles, etc. They are usually amines having from 4 to about 30, or to about 12 carbon atoms. Polar substituents may likewise be present in the amines.

The carbonyl-amino groups of the carboxy-containing interpolymers also may comprise groups derived from hydrazine and/or a hydrocarbon-substituted hydrazine including, for example, the mono-, di-, tri-, and tetrahydrocarbon-substituted hydrazines wherein the hydrocarbon substituent is either an aliphatic or aromatic substituent including, for example, the alkyl-, e.g., cyclic and/or acyclic groups, aryl-, alkylaryl-, aralkyl, etc.

The following examples illustrate esterified carboxy containing interpolymers useful in the compositions of this invention, as well as means for preparing same.

EXAMPLE A-4

A reactor is charged with 1408 parts toluene and 100 parts maleic anhydride followed by heating to 95° C. With the batch refluxing at 94–96° C. a first solution of 1.68 parts benzoyl peroxide in 51 parts toluene is charged followed by the simultaneous addition over 1.5 hours of solutions of 106.1 parts styrene with 5.1 parts methyl methacrylate and 1.68 parts benzoyl peroxide in 51 parts toluene, maintaining 94–96° C. The batch is held at 94–96° C. and 440–470 mm Hg. absolute pressure for four hours until at least 97% of maleic anhydride is reacted and the RSV @30° C. is 0.12–0.14.

A reactor is charged with 815 parts of the terpolymer slurry and 65 parts Cross Oil Co. L-40 (40N naphthenic oil, Cross Oil Co.). The mixture is stripped to remove toluene followed by addition of 104.4 parts Alfol 1218, the batch is heated to 96° C. then 5.3 parts of methanesulfonic acid and 49 parts Alfol 8–10 are charged followed by heating to 146° C. The batch is held at 146–152° C. until the acid no is between 19–21 whereupon 10.7 parts butanol are added. The reaction is continued until the acid number is 5–6, then 1.1 parts 50% aqueous NaOH are added followed by mixing for 1 hour at 150° C. The material are vacuum stripped then filtered.

To the ester before the final stripping are added 5.8 parts aminopropyl morpholine, followed by heating for 1 hour at 150° C. then addition of 1 part alkylated diphenyl amine. The batch is vacuum stripped and filtered.

EXAMPLE A-5

A reactor is charged with 6337.2 parts of the terpolymer slurry of Example A-4 and 1044 parts Alfol 1218. The mixture is heated and stirred, under $N_2$, to 95° C. A freshly prepared solution of 64.8 parts 70% methane sulfonic acid in 1045.4 parts Alfol 8–10 is charged via an addition funnel. The materials arc heated to 150° C. by removing water of esterification and excess toluene by distillation then maintained at temperature for 18 hours. Materials are 97.9% esterified by net neutralization number which is defined as the difference between the total acid content and the strong acid content. Over 0.5 hour, 102.1 parts aminopropyl morpholine are added and the materials are held at temperature for 0.5 hour, 14.7 parts of a hindered phenol are added, then the materials are stripped to 150° C. and 40–50 mm Hg. An additional 14.7 parts hindered phenol are added, then 854.2 parts Cross Oil Co. L-40, the materials are mixed thoroughly then filtered.

EXAMPLE A-6

Heat 490 parts of maleic anhydride and 5000 parts of toluene to 100° C., then add one-half of an initiator of 2.13 parts of benzoyl peroxide in 500 parts of toluene. Add 520 parts styrene and the remaining initiator solution dropwise over 0.7 hour, then maintain at 100° C. for 4 hours. Theory RSV=0.30.

This product (101 parts), Neodol 91 (56 parts), a product of Shell Chemical Company identified as a mixture of $C_9$, $C_{10}$ and $C_{11}$ alcohols, TA-1618 (92 parts), a product of Proctor & Gamble identified as a mixture of $C_{16}$ and $C_{18}$ alcohols, Neodol 25 (62 parts), a product of Shell Chemical Company identified as a mixture of $C_{12}$, $C_{13}$, $C_{14}$, and $C_{15}$ alcohols, and toluene and the contents are heated. Methane sulfonic acid (5 parts ) is added to the mixture. The mixture is heated under reflux conditions for 30 hours. The materials are vacuum stripped. The residue is mixed with 50 parts diphenyl alkane (Wibarco).

EXAMPLE A-7

Aminopropyl morpholine (12.91 parts) is added to an ester prepared as in Example A-6, before stripping. The mixture is heated under reflux conditions for an additional 4 hours. Diatomaceous earth (30 parts) and hydrotreated naphthenic oil (302 parts) are added to the mixture which is then stripped. The residue is filtered.

(B) The Ashless Dispersant

The compositions of this invention also comprise (B) a hydrocarbyl group substituted ashless dispersant. Ashless dispersants are well known in the art and are used in lubricating oil compositions to reduce or prevent the deposition of sludge or varnish on lubricated parts of the engine. Ashless dispersants are so-called despite the fact that, depending on their constitution, they may upon combustion yield a nonvolatile residue such as boric oxide or phosphorus pentoxide; however, they do not ordinarily contain metal and therefore do not yield a metal-containing ash on combustion. A critical feature of the hydrocarbyl substituted ashless dispersant is the molecular weight of the hydrocarbyl substituent. The hydrocarbyl substituent has $M_n$ ranging from about 200 to about 800, often from about 300 to about 700, preferably from about 250 to about 500.

The at least one ashless dispersant used in the compositions of this invention includes any of Mannich type dispersants, acylated amine dispersants, ester dispersants, aminophenol dispersants, aminocarbamate dispersants, alkyl phenols, amine dispersants, and mixtures thereof.

Acylated amine dispersants and ester dispersants include the ester or nitrogen-containing derivatives of hydrocarbyl substituted carboxylic acylating agents. Ester or acylated amine dispersants are prepared by reacting a hydrocarbyl substituted carboxylic acylating agent with a suitable amine or ester forming molecule. Hydrocarbyl substituted carboxylic acylating agents may be prepared by reacting an olefinic compound with a carboxylic compound capable of being substituted with the olefinic compound. Hydrocarbyl substituted carboxylic acylating agents usually contain at least about 14 aliphatic carbon atoms, often at least about 20 carbon atoms, up to about 60 carbon atoms, often up to about 35 carbon atoms in the hydrocarbyl group.

The olefinic compounds from which the hydrocarbyl substituent groups may be derived are polyolefins, homopolymers and interpolymers of polymerizable olefinic monomers of 2 to about 16 carbon atoms; usually 2 to about 6 carbon atoms. Examples include mono-olefinic monomers such as ethylene, propylene, butene-1, isobutene, and octene-1 or polyolefinic monomers (usually diolefinic monomers) such as butadiene-1,3 and isoprene. Especially preferred polyolefins are polybutenes, especially polyisobutylene, and polypropylene. Interpolymers are those in which two or more olefin monomers are interpolymerized according to well-known conventional procedures to form polyalkenes having units within their structure derived from each of said two or more olefin monomers.

Olefinic monomers are usually polymerizable terminal olefins; that is, olefins characterized by the presence in their structure of the group $<C{=}{=}CH_2$. However, polymerizable internal olefin monomers (sometimes referred to in the literature as medial olefins) characterized by the presence within their structure of the group $$C{-}C{=}{=}C{-}C$$

can also be used. When internal olefin monomers are employed, they normally will be employed with terminal olefins. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

The preparation of acylating agents by reacting an olefinic compound (e.g., a polyalkene such as polybutene) with an α,β-unsaturated carboxylic acids or derivatives thereof, is known. The process is often conducted in the presence of chlorine or by the direct thermal reaction of polyolefins with the α-β carboxylic acid or derivative thereof. Typical α,β-unsaturated carboxylic acids and derivatives include acrylic acid, methacrylic acid, maleic acid, fumaric acid, and maleic anhydride, esters thereof, anhydrides thereof, and include acid-esters of polycarboxylic compounds. Exemplary of the patent literature are the following U.S., British and Canadian patents; U.S. Pat. Nos. 3,024,237; 3,087,936; 3,172,892; 3,215,707; 3,219,666; 3,231,587; 3,245,910; 3,272,746; 3,288,714; 3,312,619; 3,341,542; 3,367,943; 3,381,022; 3,454,607; 3,470,098; 3,630,902; 3,652,616; 3,755,169; 3,868,330; 3,912,764; 4,423,435; U.K. Patent Nos. 944,136; 1,085,903; 1,162,436; 1,440,219; and Canadian Patent No. 956,397. These are hereby incorporated herein by reference for disclosure contained therein relating to general methods for preparing hydrocarbyl substituted acylating agents and dispersants therefrom, and specific disclosures of the lower molecular weight hydrocarbyl-substituted dispersants used in the compositions of this invention.

One preferred dispersant in the present composition is a hydrocarbyl substituted succinic acylating agent reacted with an amine. These succinic acylating agents consist of substituent groups and succinic groups, wherein the substituent groups are derived from olefinic compounds, often polyalkenes, being characterized by a $M_n$ value of about 200 to about 800. The succinic groups are usually derived from maleic reactants, for example maleic acid, and derivatives such as anhydrides, esters and ester acids.

In another embodiment, the acylated amine dispersants and ester dispersants may be prepared from a hydrocarbyl substituted carboxylic acylating agent obtained by reacting, optionally in the presence of an acidic catalyst, an olefinic compound having $M_n$ ranging from about 200 to about 800 with at least one carboxylic reactant selected from the group consisting of compounds of the formula $$R^3C(O)(R^4)_nC(O)OR^5 \qquad \text{(IV)}$$

wherein each of $R^3$ and $R^5$ is independently H or a hydrocarbyl group, preferably H or lower alkyl, $R^4$ is a divalent hydrocarbylene group, and n is 0 or 1, and reactive sources thereof in amounts ranging from 0.6 moles carboxylic reactant per mole of olefinic compound to 3 moles carboxylic compound per equivalent of olefinic compound. Most preferably $R^3$ is H.

Reactive sources of (IV) include compounds of the formula

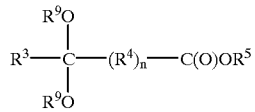

(VI)

wherein each of $R^3$ and $R^5$ and each $R^9$ is independently H or a hydrocarbyl group, $R^4$ is a divalent hydrocarbylene group, and n is 0 or 1. These include acetals, ketals, hemiacetals and hemiketals of (IV) and esters thereof. Highly preferred are the compounds wherein one of $R^9$ is hydrocarbyl and one is H:

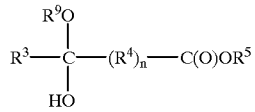

(V)

wherein each of $R^3$ and $R^5$ is independently H or a hydrocarbyl group, especially wherein the hydrocarbyl group is lower alkyl. $R^4$ is a divalent hydrocarbylene group, preferably lower alkylene, $R^9$ is hydrocarbyl, preferably lower alkyl, and n is 0 or 1, preferably 0. Especially preferred are the glyoxylate lower alkyl ester, lower alkyl hemiacetals. Cyclic trimers are useful.

Reactive equivalents include a compound of the formula

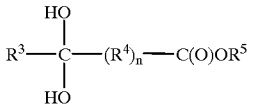

(VII)

wherein each of $R^3$ and $R^5$ is independently H or alkyl. Such compounds arise when the carboxylic acid or ester reactant is hydrated.

Examples are glyoxylic acid, and other omega-oxoalkanoic acids, glyoxylic acid hydrate, keto alkanoic acids such as pyruvic acid, levulinic acid, ketovaleric acids, ketobutyric acids, esters thereof, preferably the lower alkyl esters, methyl glyoxylate methyl hemiacetal, 4-formylbenzoic acid, 4-formylphenoxyacetic acid, esters thereof, carboxy benzaldehyde, and numerous others. The skilled worker, having the disclosure before him, will readily recognize the appropriate carboxylic reactant (B) to employ to generate a given intermediate.

In a preferred embodiment, $R^3$ and one $R^9$ are hydrogen and the other $R^9$ and $R^5$ are methyl. In this preferred embodiment, the reactant is represented by the structure

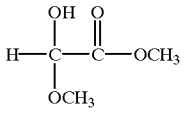

and known as glyoxylic acid met y ester methylhemiacetal. It is marketed by DSM Fine Chemicals.

Acylated amine and ester dispersants are prepared by reacting the hydrocarbyl substituted carboxylic acylating agent with an amine or ester forming reactant.

These products, dispersants prepared therefrom, and methods for preparing these are described in U.S. Pat. No. 5,696,067 and U.S. Pat. No. 5.696,068, in European Patent Publications 0759443, 0759444, and 0759435, and in PCT publication WO98/05741, each of which is hereby incorporated herein by reference for relevant disclosures of dispersants and methods for preparing same contained therein.

The amines used in preparing acylated amine dispersants are characterized by the presence within their structure of at least one H— —N<group. They may be either monoaminie or polyamine compounds. The amines can be aliphatic, cycloaliphatic, aromatic, or heterocyclic. For purposes of this invention, hydrazine and substituted hydrazines containing up to three substituents are included as amines. Mixtures of two or more amines can be used in the reaction with one or more acylating reagents. Preferably, the amine contains at least one primary amino group (i.e., —$NH_2$) and more preferably the amine is a polyamine, especially a polyamine containing at least two H— —N<groups, either or both of which are primary or secondary amines.

Specific examples of monoamines include ethylamine, diethylamine, laurylamine, methyl laurylamine, benzylamine, cyclohexylamines, and the like.

Polyamines include aliphatic, cycloaliphatic and aromatic polyamines analogous to the above-described monoamines except for the presence within their structure of one or more additional amino nitrogen. Examples of such polyamines include tetraethylene pentamine, N-amino-propyl-cyclohexylamines, 1,4-diaminocyclohexane, and the like.

Heterocyclic mono- and polyamines are those containing at least one primary or secondary amino group and at least one nitrogen as a heteroatom in a heterocyclic ring. Heterocyclic amines can contain hetero atoms other than nitrogen, especially oxygen and sulfur, and can contain more than one nitrogen hetero atom. Five- and six-membered heterocyclic rings are preferred. Examples include piperidines, piperazines, thiomorpholines, morpholines, pyrrolidines, especially those having aminoalkyl substituents a nitrogen atom forming part of the hetero ring, for example, N-aminopropylmorpholine, N-aminoethylpiperazine, and N,N'-di-aminoethylpiperazine.

Hydroxyamines, both mono- and polyamines, analogous to those described above are also useful. Hydroxy-substituted amines are those having hydroxy substituents bonded directly to a carbon atom other than a carbonyl carbon atom; that is, they have hydroxy groups capable of functioning as alcohols. Examples include ethanolamine, diethanolamine, di-(3-hydroxypropyl)-amine, 3-hydroxybutyl-amine, 4-hydroxybutyl-amine, di-(2-hydroxypropyl)-amine, N-hydroxyethyl ethylene diamine, N-(2-hydroxyethyl)-cyclohexylamine, para-hydroxyaniline, N-hydroxyethyl piperazine, and the like.

Aminosulfonic acids and derivatives thereof are suitable as amines. These can be aliphatic, cycloaliphatic, or aromatic aminosulfonic acids and the corresponding functional derivatives of the sulfo group. Specifically, the aminosulfonic acids can be aromatic aminosulfonic acids or monoamino aliphatic sulfonic acids These aminosulfonic acids may be reacted with the acylating reagents of this invention in the same way as other amino compounds. Other suitable aminosulfonic acids and derivatives thereof are disclosed in U.S. Pat. Nos. 3,926,820; 3,029,250; and 3,367,843.

Hydrazine and substituted-hydrazine can also be used to prepare the acylated nitrogen dispersants. At least one of the nitrogens in the hydrazine and preferably at least two hydrogens are bonded directly to hydrazine nitrogen. More preferably, both hydrogens are on the same nitrogen. Substituents which may be present on the hydrazine including alkyl, alkenyl, aryl, aralkyl, alkaryl, and the like. Usually, the substituents are alkyl, especially lower alkyl, phenyl, and substituted phenyl.

Branched polyalkylene polyamines are suitable for use in preparing acylated amine dispersants. These are polyalkylene polyamines wherein the branched group is a side chain containing on the average of at least one nitrogen-bonded aminoalkylene group per nine amino units present on the main chain, for example, 1–4, preferably one, of such branched chains per nine units on the main chain. Thus, these polyamines contain at least three primary amino groups and at least one tertiary amino group.

U.S. Pat. Nos. 3,200,106 and 3,259,578 disclose methods of preparing such polyamines and processes for reacting them with carboxylic acid acylating agents since analogous processes can be used with the acylating reagents of this invention.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl) amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst.

The amine condensates and methods of making the same are described in Steckel (U.S. Pat. No. 5,053,152) which is incorporated herein by reference for its disclosure to the condensates and methods of making.

Suitable amines also include polyoxyalkylene polyamines, e.g., polyoxyalkylene diamines and polyoxyalkylene triamines, having average molecular weights ranging from about 200 to 4000 and preferably from about 400 to 2000.

The preferred polyoxyalkylene polyamines for purposes of this invention include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403, etc.".

U.S. Pat. Nos. 3,804,763 and 3,948,800 disclose such polyoxyalkylene polyamines and process for acylating them with carboxylic acid acylating agents which processes can be applied to their reaction with the acylating reagents of this invention.

Another preferred group of amines for use in preparing acylated amine dispersants are the alkylene polyamines, including the polyalkylene polyamines, as described in more detail hereinafter. The alkylene polyamines include those conforming to the formula $$H—N—(—Alkylene—NR'')_n—R''$$

wherein n is from 1 to about 10, usually an average value of from about 2 to about 7; each of R' and R" is independently a hydrogen atom, a hydrocarbyl group or a hydroxy-substituted hydrocarbyl group having up to about 30 atoms, and the "Alkylene" group has from about 1 to about 10 carbon atoms but the preferred alkylene is ethylene or propylene. Especially preferred are the alkylene polyamines where each R" is hydrogen with the ethylene polyamines and mixtures of ethylene polyamines being the most preferred. Such alkylene polyamines include ethylene-, butylene-, propylene-, pentylene-, hexylene-, heptylene-, higher homologs of such amines and related aminoalkyl-substituted piperazines.

Alkylene polyamines useful in preparing the carboxylic derivative compositions include ethylene diamine, triethylene tetramine, propylene diamine, trimethylene diamine, octamethylene diamine, tetraethylene pentamine, pentaethylene hexamine, di(trimethylene)triamine, N-(2-aminoethyl)piperazine, and the like. Higher homologs as are obtained by condensing two or more of the above-illustrated alkylene amines are useful as are mixtures of two or more of any of the aforedescribed polyamines.

Ethylene polyamines are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for their disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Hydroxyalkyl alkylene polyamines having one or more hydroxyalkyl substituents on the nitrogen atoms, are also useful in preparing amide or ester dispersants. Preferred hydroxyalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl)ethylene diamine, N,N-bis(2-hydroxyethyl) ethylene diamine, 1-(2-hydroxyethyl)piperazine, monohydroxypropyl-substituted diethylene triamine, N-(3-hydroxybutyl)tetramethylene diamine, etc. Higher homologs as are obtained by condensation of the above-illustrated hydroxy alkylene polyamines through amino radicals or through hydroxy radicals are likewise useful. Condensation through amino radicals results in a higher amine accompanied by removal of ammonia and condensation through the hydroxy radicals results in products containing ether linkages accompanied by removal of water.

The compositions produced from the acylating reagents and the amines described hereinbefore produce acylated amines which include amine salts, amides, imides and imidazolines as well as mixtures thereof. To prepare carboxylic acid derivatives from the acylating reagents and the amines, one or more acylating reagents and one or more amines are heated, optionally in the presence of a normally liquid, substantially inert organic liquid solvent/diluent, at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amine are reacted in amounts sufficient to provide from about one-half equivalent to about 2 moles of amine per equivalent of acylating reagent. For purposes of this invention an equivalent of amine is that amount of the amine corresponding to the total weight of amine divided by the total number of nitrogens present. Thus, octylamine has an equivalent weight equal to its molecular weight; ethylene diamine has an equivalent weight equal to one-half its molecular weights; and aminoethylpiperazine has an equivalent weight equal to one-third its molecular weight.

Another variety of ashless dispersants which may be used in the composition of the present invention are the ester dispersants. Ester dispersants are prepared by reacting any of the hydrocarbyl substituted carboxylic acylating agents described hereinabove, for example, an alkenylsuccinic anhydride with an ester forming reagent, usually a hydroxy compound, often a polyol. The nature of ester dispersants and their preparation are described in, for example, U.S. Pat. No. 3,522,179. The esters produced by the reaction between the hydroxy compound and the hydrocarbyl substituted acylating agents may be further reacted with amines. Such materials, and methods for producing them, are disclosed in U.S. Pat. No. 3,804,763. Hydroxy amines may be included as the hydroxy reactant, and polyoxyalkylene polyamines and alkaline polyamines may be used as amine reactants with the subject esters. The amines, substituted amines, and hydroxy amines disclosed as useful in the preparation of the acylated amine dispersant are useful in this preparation as well.

Another type of useful ashless dispersant is an alkylated phenol. The alkyl substituent on the phenol may contain from about 12 to about 60 carbon atoms. These are typically prepared by reacting a phenolic compound, such as phenol, naphthol, etc. with an olefinic compound, often a polyalkene, in the presence of a Lewis acid catalyst. $AlCl_3$ and $BF_3$ and its complexes with , for example ether, are preferred illustrative examples of Lewis acids. Useful alkylated phenols are well known in the art and are described, for example, in U.S. Pat. Nos. 4,708,809 and 4,740,321, each of which is hereby expressly incorporated herein for disclosures of alkylated phenolic compounds useful in the compositions of this invention and general disclosures of how such materials are prepared.

Another type of ashless dispersant which is useful in the present invention is the so-called Mannich dispersant. Mannich dispersants are generally prepared by condensing one mole of an alkyl-substituted phenol with about 1 to 2.5 moles of an aldehyde, usually formaldehyde, and about 0.5 to 2 moles of an amine. The alkylated phenols and primary and secondary amines described above as suitable for use in preparing the acylated amine dispersants are suitable for the preparation of the Mannich dispersants. Polyalkylene polyamines are convenient materials for use in the preparation of Mannich dispersants. The dispersants may be prepared by the methods set forth in U.S. Pat. Nos. 3,424,808; 3,639,242; 3,649,229; 3,639,659; 3,658,836; 3,697,574; 3,702,757; 3,703,536; 3,704,308; and 3,708,422, or similar methods well known to those skilled in the art.

Amine dispersants are hydrocarbyl amines, both monoamines and polyamines. These are generally prepared by reacting a chlorinated polyolefin having a molecular weight of at least about 200 up to about 800 with ammonia or amine. Such amines are known in the art and described, for example, in U.S. Pat. Nos. 3,275,554 and 3,438,757, both of which are expressly incorporated herein by reference for their disclosure of such amines and how to prepare these amines.

Also included among ashless dispersants are hydrocarbyl substituted aminophenol dispersants. These are frequently obtained by nitrating hydrocarbyl substituted phenols as described hereinabove with nitric acid, then reducing the nitro group to an amino group employing reducing agents such as hydrazine or hydrogen. Patents containing descriptions of useful aminophenol compounds and methods for preparing them include U.S. Pat. No. 4,100,082; U.S. Pat. Nos. 4,200,545; 4,320,020; 4,320,021; 4,45,138; and 4,379,065.

Aminocarbamate dispersants and methods for preparing same are described in U.S. Pat. No. 4,288,612.

Any of these may be post-treated as discussed hereinafter under the heading 1. Ashless Dispersants and subsection (4) relating to post-treated dispersants.

The following Examples illustrate several of the ashless dispersants useful in the compositions of this invention.

EXAMPLE B-1

A reactor is charged with 800 parts of a polybutene having $\overline{M}_n$=586 and containing about 80 mole % terminal vinylidene groups and 3 parts 70% aqueous methane sulfonic acid. The materials are mixed while heating, under $N_2$, to 150° C. followed by dropwise addition of 262.7 parts 50% aqueous glyoxylic acid over 2 hours, collecting aqueous distillate in a Dean-Stark trap. The reaction mixture is held at 150° C. for a total of 6 hours and filtered at 145° C. The filtrate has total acid no=55.6 and saponification no=89.45. The product contains (TLC-FID) 7.2% unreacted polyisobutene. A reactor is charged with 400 parts of this product and 78.2 parts of aminoethylpiperazine. The reactants are mixed while heating, under $N_2$, to 160° C., held at temperature for 6 hours, stripped to 160° C., 25 mm Hg, cooled to 120° C. and filtered. The filtrate contains 3.49% N.

EXAMPLE B-2

The procedure of Example 1 is repeated replacing glyoxylic acid with an equivalent amount of glyoxylic acid methyl ester, methyl hemiacetal.

EXAMPLE B-3

A reactor is charged with 55.1 parts of the condensation product obtained by reacting 1000 parts of ethylene polyamine bottoms and 591 parts tris-hydroxymethylaminomethane in the presence of 15.9 parts 85% $H_3PO_4$ and neutralized with 22.1 parts 50% aqueous NaOH, and 232 parts mineral oil. At 80–91° C. over 0.25 hour are added 100 parts of a polyisobutylene substituted succinic anhydride having average molecular weight of about 450 (MCP-815, Mobil). A viscous material forms whereupon 50 parts additional mineral oil and 75 parts toluene are stirred in. Temperature drops to 80° C., the temperature is increased to 90° C. over 0.5 hour. Additional 85 parts MCP-815 are added over 0.25 hour, maintain 90° C. for 0.75 hour, then begin $N_2$ blowing. Temperature is increased to 158° C. over 2.3 hours and is maintained at temperature for a total of 7.25 hour. The reaction is stripped to 158° C. at 15 mm Hg and the residue is filtered at 115° C.

EXAMPLE B-4

A reactor is charged with 220.2 parts of MCP-815 and 242.5 parts mineral oil. The materials are heated to 116° C. under $N_2$, whereupon 27.7 parts polyamine bottoms having equivalent weight of 40.5 (HPA-X, Union Carbide) are added over 0.2 hours at 116–122° C. (exothermic). Materials are heated at 114–118° C. for 0.3 hour, then temperature is increased to 140° C. over 0.9 hour. Temperature is increased to 154° C. over 0.4 hours and reaction is maintained at temperature for 5.5 hours. Materials are filtered at 130° C.

The following Examples illustrate additive concentrates of this invention. The concentrates are prepared by combining the specified ingredients in the indicated amounts and diluent oil to make the total 100 parts by weight. The amounts shown are parts by weight and, unless indicated otherwise, are amounts of chemical present on an oil-free basis. Amounts of components of Examples are as prepared, including diluent, if any. Thus, for example, an additive comprising 50% oil used at 10% by weight in a blend, provides 5% by weight of chemical. These examples are presented for illustrative purposes only, and are not intended to limit the scope of this invention.

EXAMPLE A

An additive concentrate is prepared by mixing 4.9 parts of propoxylated t-dodecyl mercaptan, 1.44 parts dinonyldiphenyl amine, 3.3 parts dibutyl dithiocarbamic acid/methyl acrylate adduct, 1.3 parts dibutyl hydrogen phosphite, 0.13 parts 2,5-dimercapto-1,3,4-thiadiazole derived corrosion inhibitor, 1.3 parts borated $C_{16}$ epoxide, 2.2 parts borated polyisobutylene ($M_n$~1000) substituted succinic anhydride/polyethylene polyamine reaction product, 23.57 parts of the product of Example B-4, and 58.94 parts of the product of Example A-3.

EXAMPLE B

An additive concentrate is prepared by mixing 3.02 parts of propoxylated t-dodecyl mercaptan, 0.85 parts dinonyldiphenyl amine, 2 parts dibutyl dithiocarbamic acid/methyl acrylate adduct, 0.8 parts dibutyl hydrogen phosphite, 0.08 parts 2,5-dimercapto-1,3,4-thiadiazole derived corrosion inhibitor, 0.81 parts borated $C_{16}$ epoxide, 1,35 parts borated polyisobutylene ($M_n$~1000) substituted succinic anhydride/polyethylene polyamine reaction product, 14.53 parts of the product of Example B-4, 36.33 parts of the product of Example A-5, 1.03 parts of reaction product of 2,5-dimercapto-1,3,4-thiadiazole with polyisobutylene ($M_n$~1000) substituted succinic anhydride/pentaerythritol-polyethylene polyamine post treated product, and 36.33 parts of the product of Example A-3.

EXAMPLE C

An additive concentrate is prepared by mixing 4.75 parts of propoxylated t-dodecyl mercaptan, 1.33 parts dinonyldiphenyl amine, 3.17 parts dibutyl dithiocarbamic acid/methyl acrylate adduct, 1.27 parts dibutyl hydrogen phosphite, 0.13 parts 2,5-dimercapto-1,3,4-thiadiazole derived corrosion inhibitor, 1.27 parts borated $C_{16}$ epoxide, 2.12 parts borated polyisobutylene ($M_n$~1000) substituted succinic anhydride/polyethylene polyamine reaction product, 22.83 parts of the product of Example B-4, 1.62 parts of reaction product of 2,5-dimercapto-1,3,4-thiadiazole with polyisobutylene ($M_n$~1000) substituted succinic anhydride/pentaerythritol-polyethylene polyamine post treated product, and 57.07 parts of the product of Example A-3.

The following are examples to be compared with products of this invention:

COMPARATIVE EXAMPLE A

An additive concentrate as in Example C is prepared replacing the composition of Example B-4 with 10.84 parts polyisobutylene ($M_n$~1000) substituted succinic anhydride/polyethylene polyamine reaction product.

COMPARATIVE EXAMPLE B

An additive concentrate as in Comparative Example A is prepared replacing the composition of Example A-3 with 9 parts of the composition of Example A-5.

Storage stability of the additive concentrates is determined by maintaining the concentrates at room temperature (RT) and at 65° C. for a period of 4 weeks, observing the appearance at weekly intervals.

| | RT | | | | 65° C. | | | |
|---|---|---|---|---|---|---|---|---|
| Week: | 1 | 2 | 3 | 4 | 1 | 2 | 3 | 4 |
| Example | | | | | | | | |
| A | Z | Z | Z | Z | Z | Z | Z | Z |
| B | Z | Z | Z | Z | Z | Z | Z/L | Z/L |

-continued

| | RT | | | | 65° C. | | | |
|---|---|---|---|---|---|---|---|---|
| Week: | 1 | 2 | 3 | 4 | 1 | 2 | 3 | 4 |
| C | Z | Z | Z | Z | Z | Z/L | H | H |
| Comp. A | Z | Z | Z | Z | Sep | Sep | Sep | Sep |
| Comp. B | Z | Z | Z | Z | Sep | Sep | Sep | Sep |

Legend:
Z = Hazy
L = Light sediment
H = Heavy sediment
Sep = Separation of components The expressions "light sediment" and "heavy sediment" when used herein refer to usually opaque segments located at the bottom of the sample. These segments contain a mixture consisting primarily of the liquid making up the sample, but containing very small amounts of other material which may be suspended in a somewhat non-uniform manner. These are not considered "separation" of components. "Separation of components" means substantially complete separation of mutually incompatible materials.

As is apparent from the foregoing compatibility data, the components making up the compositions of this invention do not undergo separation of components, while the comparative compositions, wherein 100% of the ashless dispersant has a hydrocarbyl-group having $M_n$ greater than 800, separate into 2 distinct layers, one of which is rich in the polymeric carboxylic ester viscosity improver and the other layer is rich in the ashless dispersant.

As noted hereinabove, the additive concentrates of this invention are incorporated into oils of lubricating viscosity to prepare lubricating compositions. Oils of lubricating viscosity include natural or synthetic lubricating oils and mixtures thereof.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Hydrotreated naphthenic oils are well known. Oils of lubricating viscosity derived from coal or shale are also useful.

Synthetic lubricating oils include hydrocarbon oils and halosubstituted hydrocarbon oils such as polymerized and interpolymerized olefins, etc. and mixtures thereof, alkylbenzenes, diphenyl alkanes, polyphenyl, (e.g., biphenyls, terphenyls, alkylated polyphenyls, etc.), alkylated diphenyl ethers and alkylated diphenyl sulfides and their derivatives, analogs and homologues thereof and the like.

Alkylene oxide polymers and interpolymers and derivatives thereof, and those where terminal hydroxyl groups have been modified by esterification, etherification, etc., constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyether polyols.

Other synthetic lubricating oils include liquid esters of phosphorus-containing acids, polymeric tetrahydrofurans, alkylated diphenyloxides and the like.

Unrefined, refined and rerefined oils, either natural or synthetic (as well as mixtures of two or more of any of these)

of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III, U.S. Pat. No. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

The lubricating oil compositions of the instant invention generally comprise an oil of lubricating viscosity and the additive concentrates of this invention. Other ingredients may be included in the lubricating compositions, including auxiliary dispersants and detergents of the ash-containing and ashless type which may be post-treated as discussed hereinbelow, antioxidants, extreme pressure and antiwear additives, antifoam agents, seal swell agents, friction modifiers, and others. A discussion of these follows:

1. Ashless Dispersants. Non-borated ashless dispersants may be incorporated within the final fluid composition in an amount comprising up to 10 weight percent on an oil-free basis. However, no more than 50% by weight of the ashless dispersants may contain hydrocarbyl substituents having Mn (determined by gel permeation chromatography) greater than 800, more often greater than 900. Many types of ashless dispersants listed below are known in the art. Borated ashless dispersants may also be included.

(1) "Carboxylic dispersants" are reaction products of carboxylic acylating agents (acids, anhydrides, esters, etc.) containing at least about 34 and preferably at least about 54 carbon atoms are reacted with nitrogen-containing compounds (such as amines), organic hydroxy compounds (such aliphatic compounds including monohydric and polyhydric alcohols, or aromatic compounds including phenols and naphthols), and/or basic inorganic materials. These reaction products include imide, amide, and ester reaction products of carboxylic acylating agents. Examples of these Carboxylic acylating agents are taught in U.S. Pat. Nos. 2,444,328; 3,219,666; 4,234,435; 5,696,060 and 5,696,067, the disclosures of which are hereby incorporated by reference.

The amine may be a mono- or polyamine. Amines useful for preparing these dispersants are discussed hereinabove with respect to (B) the ashless dispersant. Useful amines include those disclosed in U.S. Pat. No. 4,234,435 (Meinhardt) and U.S. Pat. No. 5,230,714 (Steckel) which are incorporated herein by reference.

Examples of these "carboxylic dispersants" are described in British Patent 1,306,529 and in many U.S. Patents including the following: U.S. Pat. No. 3,219,666; 3,316,177; 3,340,281; 3,351,552; 3,381,022; 3,433,744; 3,444,170; 3,467,668; 3,501,405; 3,542,680; 3,576,743; 3,632,511; 4,234,435; 5,696,060; 5,696,067; and Re 26,433.

(2) "Amine dispersants" are reaction products of relatively high molecular weight aliphatic or alicyclic halides and amines, preferably polyalkylene polyamines. Examples thereof are described for Example, in the following U.S. Pat. Nos. 3,275,554, 3,438,757, 3,454,555, and 3,565,804.

(3) "Mannich dispersants" are the reaction products of alkyl phenols in which the alkyl group contains at least about 30 carbon atoms with aldehydes (especially formaldehyde) and amines (especially polyalkylene polyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(4) Post-treated dispersants are obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

(5) Polymeric dispersants are interpolymers of oil-solubilizing monomers such as decyl methacrylate, vinyl decyl ether and high molecular weight olefins with monomers containing polar substituents, e.g. aminoalkyl acrylates or acrylamides and poly-(oxyethylene)-substituted acrylates. Examples of polymer dispersants thereof are disclosed in the following U.S. Pat. Nos. 3,329,658, 3,449,250, 3,519,656, 3,666,730, 3,687,849, and 3,702,300.

The above-noted patents are incorporated by reference herein for their disclosures of ashless dispersants.

Borated dispersants are described in U.S. Pat. Nos. 3,087,936 and 3,254,025 which are incorporated herein by reference for disclosure of borated dispersants.

Also included as possible dispersant additives are more disclosed in U.S. Pat. Nos. 5,198,133 and 4,857,214 which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Antioxidants. Most oleaginous compositions will contain a conventional quantity of one or more antioxidants in order to protect the composition from premature degradation in the presence of air, especially at elevated temperatures. Typical antioxidants include hindered phenolic antioxidants, secondary aromatic amine antioxidants, sulfurized phenolic antioxidants, oil-soluble copper compounds, phosphorus-containing antioxidants, and the like.

Illustrative sterically hindered phenolic antioxidants include ortho-alkylated phenolic compounds such as 2,6-di-tertbutylphenol, 4-methyl-2,6-di-tertbutylphenol, 2,4,6-tri-tertbutylphenol, 2-tert-butylphenol, their analogs and homologs, and numerous others known to those skilled in the art. Mixtures of two or more such mononuclear phenolic compounds are also suitable.

Other phenol antioxidants for use in the compositions of this invention are methylene-bridged alkylphenols, and these can be used singly or in combinations with each other or in combination with sterically hardened unbridged phenolic compounds. Illustrative methylene-bridged compounds include 4,4'-methylenebis(6-tert-butyl o-cresol), 2,2'-methylenebis(4-methyl-6-tert-butylphenol) 4,4'-methylenebis(2,6-di-tertbutylphenol), and similar compounds. Particularly preferred are mixtures of methylene-bridged alkylphenols such as are described in U.S. Pat. No. 3,211,652, all disclosure of which is incorporated herein by reference.

Amine antioxidants, especially oil-soluble aromatic secondary amines can also be used in the compositions of this invention. Although aromatic secondary monoamines are preferred aromatic secondary polymixture also suitable. Illustrative aromatic secondary monoamines include diphenylamine, alkyl diphenylamines containing 1 to 2 alkyl substituents each having up to about 16 carbon atoms, phenyl-α-naphthylamine, phenyl-γ-naphthylamine, alkyl- or aralkylsubstituted phenyl-α-naphthylamine containing one or two alkyl or aralkyl groups each having up to about 16 carbon atoms, alkyl- or aralkyl-substituted phenyl-β-naphthylamine containing one or two alkyl or aralkyl groups each having up to about 16 carbon atoms, alkylated p-phenylene diamines available from Goodyear under the tradename "Wingstay 100" and from Uniroyal, and similar compounds.

A preferred type of aromatic amine antioxidant is an alkylated diphenylamine of the general formula $$R_1—C_6—H_4—NH—C_6H_4—R_2$$

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)(amine) wherein the nonyl groups are branched.

Another useful type of antioxidant for inclusion in the compositions of this invention is comprised of one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tertbutylphenol, and about 2% of 2,4-di-tertbutylphenol.

Mixtures of different antioxidants can also be used. One suitable mixture is comprised of a combination of (i) an oil-soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl) amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii). The antioxidant discussion above is as put forth in U.S. Pat. No. 5,328,619 which is incorporated herein by reference.

Other useful antioxidants are those included in the disclosure of U.S. Pat. No. 4,031,023 which is herein incorporated by reference. The referenced antioxidants of the '023 patent are then included under the formula:

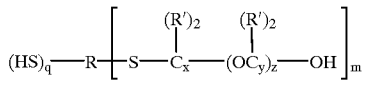

wherein R is a hydrocarbyl or substituted hydrocarbyl containing up to about 30 carbon atoms and having a valence of m+q; each R' is independently selected from hydrogen and a hydrocarbon-based group of up to about 20 carbon atoms; x and y are independently from 2 to 5; z is from zero to 5; q is from zero to 4 and m is from 1 to 5 with the proviso that m+q is from 1 to 6, have increased resistance to oxidative degradation and anti-wear properties. Antioxidants are included in lubricating compositions at about 0.1–5 weight percent.

3. Seal Swell Compositions. Compositions which are designed to keep seals pliable are also well known in the art. A preferred seal swell composition is isodecyl sulfolane. The seal swell agent is incorporated into lubricating compositions at about 0.1–3 weight percent. Substituted 3-alkoxysulfolanes are disclosed in U.S. Pat. No. 4,029,587 which is incorporated herein by reference.

4. Friction Modifiers. Friction modifiers are also well known to those skilled in the art. A useful list of friction modifiers are included in U.S. Pat. No. 4,792,410 which is incorporated herein by reference. U.S. Pat. No. 5,110,488 discloses metal salts of fatty acids and especially zinc salts and is incorporated herein by reference for said disclosures. Said list of friction modifiers includes: fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines and mixtures thereof.

The preferred friction modifier is a borated fatty epoxide as previously mentioned as being included for its boron content. Friction modifiers are included in lubricating compositions in the amounts of 0.02–3 weight percent and may be a single friction modifier or mixtures of two or more.

Friction modifiers also include metal salts of fatty acids. Preferred cations are zinc, magnesium, calcium, barium, and sodium and any alkaline, or alkaline earth metals may, be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

5. Antiwear/Extreme Pressure Agents. Zinc salts are added to lubricating compositions in amounts of 0.1–5 weight percent to provide antiwear protection. The zinc salts are normally added as zinc salts of phosphorodithioic acids. Among the preferred compounds are zinc diisooctyl dithiophosphate and zinc dibenzyl dithiophosphate. Phosphites such as di- and triphenyl phosphite and other dialkyl phosphites are useful. Also included in lubricating compositions in the same weight percent range as the zinc salts to give antiwear/extreme pressure performance is dibutyl hydrogen phosphite (DBPH) and triphenyl monothiophosphate, and the thiocarbamate ester formed by reacting dibutyl amine-carbon disulfide- and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference. Phosphorus acids, especially phosphoric acid, also is useful.

Antiwear synergists, which enhance the antiwear performance of many phosphorus-containing extreme pressure/antiwear additives may be used. Examples of such materials include 2,5-dimercapto-1,3,4-thiadiazole and/or derivatives thereof. Such materials are described in European Patent Publication 0761805, which is hereby incorporated herein by reference.

6. Viscosity Modifiers. Viscosity modifiers (VM) are well known. Examples are polymethacrylates, polyacrylates, polyolefins, styrene-maleic ester copolymers, and similar polymeric substances including homopolymers, copolymers and graft copolymers.

7. Pour Point Depressants. These compositions are particularly useful to improve low temperature qualities of a lubricating oil. A preferred pour point depressant is an alkylnaphthalene. Pour point depressants are disclosed in U.S. Pat. No. 4,880,553, which is incorporated herein by reference.

8. Detergents. Lubricating compositions in many cases also include detergents. Detergents as used herein are metal salts of organic acids. The organic acid portion of the detergent is a sulfonate, carboxylate, phenate, salicylate. The metal portion of the detergent is an alkali or alkaline earth metal. Preferred metals are sodium, calcium, potassium and magnesium. Typically, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should contain on average from about 10 to about 40 carbon atoms, preferably from about 12 to about 36 carbon atoms and preferably from about 14 to about 32 carbon atoms on average. Similarly, the phenates, oxylates and carboxylates have a substantially oleophilic character.

While the carbon atoms may be either aromatic or paraffinic configuration, it is highly preferred that alkylated aromatics be employed. While naphthalene based materials may be employed, the aromatic of choice is the benzene moiety.

The most preferred composition is thus an overbased monosulfonated alkylated benzene, and is preferably the monoalkylated benzene. Typically, alkyl benzene fractions are obtained from still bottom sources and are mono- or di-alkylated. It is believed, in the present invention, that the mono-alkylated aromatics are superior to the dialkylated aromatics in overall properties.

It is preferred that the salt be "overbased". By overbasing, it is meant that a stoichiometric excess of the metal be present over that required to neutralize the anion of the salt. The excess metal from overbasing has the effect of neutralizing acids which may build up in the lubricant. A second advantage is that the overbased salt increases the dynamic coefficient of friction. Typically, the excess metal will be present over that which is required to neutralize the anion at about in the ratio of up to about 30:1, preferably 5:1 to 18:1 on an equivalent basis.

The amount of the overbased salt utilized in lubricating compositions is typically from about 0.1 to about 5%, on an oil free basis. The overbased salt is usually made up in about 50% oil with a TBN range of 10–600 on an oil free basis. Borated and non-borated overbased detergents are described in U.S. Pat. Nos. 5,403,501 and 4,792,410 which are herein incorporated by reference for disclosure pertinent hereto.

The following examples describe lubricating oil compositions of the present invention. Each comprises a mineral oil of lubricating viscosity, a silicone antifoam and 15.77% by weight of the indicated additive concentrate:

| Example | Additive Concentrate |
|---|---|
| L-1 | B |
| L-2 | C |

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. A homogeneous composition comprising (A) at least one polymeric carboxylic ester viscosity improver optionally containing nitrogen-containing groups, and (B) at least one hydrocarbyl group substituted ashless dispersant wherein the hydrocarbyl group has $M_n$ ranging from about 200 to about 800, and the weight ratio of (A):(B) ranges from about 3:1 to about 1:3.

2. The composition of claim 1 wherein the hydrocarbyl group is derived from a polyolefin.

3. The composition of claim 1 wherein the polymeric carboxylic ester viscosity improver is at least one member selected from the group consisting of (1) polyacrylate ester copolymers, optionally containing nitrogen containing groups, containing from 2 to about 30 carbon atoms in the ester group and having $M_n$ ranging from about 10,000 to about 150,000; and (2) esterified carboxy-containing interpolymers, having RSV ranging from about 0.05 to about 0.35 before esterification, optionally neutralized with an amine, said interpolymers derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms.

4. The composition of claim 3 wherein the viscosity improver comprises the polyacrylate ester wherein at least about 50 mole % of the esters contain at least 7 carbon atoms in the ester alkyl group.

5. The composition of claim 3 wherein the viscosity improver comprises the polyacrylate ester wherein the $M_n$ ranges from about 20,000 to about 100,000.

6. The composition of claim 4 wherein the polyacrylate ester further comprises from about 0.1% to about 45% by weight of nitrogen containing units derived from at least one member of the group consisting of vinyl substituted nitrogen heterocyclic monomers, dialkylaminoalkyl acrylate monomers, dialkylaminoalkyl acrylamide monomers, N-tertiary alkyl acrylamides, and vinyl substituted amines.

7. The composition of claim 3 wherein the viscosity improver comprises an esterified carboxy-containing interpolymer neutralized with an amine having an average of from 1 to about 1.5 primary or secondary amino group, one of the monomers is styrene and the other is at least one of maleic anhydride and a lower alkyl methacrylate.

8. The composition of claim 7 wherein the amine has an average of from 1 to about 1.1 primary or secondary amino groups.

9. The composition of claim 3 wherein the viscosity improver comprises the esterified carboxy-containing interpolymer wherein one of the monomers is a vinyl aromatic compound and the alpha, beta-unsaturated acid or anhydride, or ester thereof is at least one member selected from the group consisting of maleic acid or anhydride, itaconic acid or anhydride, fumaric acid, α-methylene glutaric acid, acrylic acid, methacrylic acid or an ester of any of these.

10. The composition of claim 9 wherein the interpolymer is derived from styrene and maleic anhydride.

11. The composition of claim 10 wherein the interpolymer is further derived from methacrylic acid or an ester thereof.

12. The composition of claim 9 wherein the carboxy containing interpolymer is neutralized with an amine having an average of from 1 to about 1.1 primary or secondary amino groups.

13. The composition of claim 1 wherein the at least one hydrocarbyl group substituted ashless dispersant has a hydrocarbyl group having $M_n$ ranging from about 300 to about 700.

14. The composition of claim 1 wherein the at least one ashless dispersant (B) is at least one member of the group consisting of Mannich type dispersants, acylated amine dispersants, ester dispersants, aminophenol dispersants, aminocarbamate dispersants, alkyl phenols, and amine dispersants.

15. The composition of claim 14 wherein the ashless dispersant (B) is an acylated amine dispersant.

16. The composition of claim 15 wherein the acylated amine dispersant is selected from the group consisting of hydrocarbyl substituted succinic derivatives and derivatives of the reaction product of an olefinic compound having $M_n$ ranging from about 200 to about 800 with a carboxylic reagent selected from the group consisting of compounds of the formula $$R^3C(O)(R^4)_nC(O)OR^5 \quad \text{(IV)}$$

wherein each of $R^3$ and $R^5$ is independently H or a hydrocarbyl group, $R^4$ is a divalent hydrocarbylene group, and n is 0 or 1, and reactive sources thereof.

17. The composition of claim 16 wherein the acylated nitrogen containing dispersant is the reaction product of an olefinic compound having $M_n$ ranging from about 200 to about 800 with a carboxylic reagent selected from the group consisting of compounds of the formula $$R^3C(O)(R^4)_nC(O)OR^5 \quad \text{(IV)}$$

wherein each of $R^3$ and $R^5$ is independently H or a hydrocarbyl group, $R^4$ is a divalent hydrocarbylene group, and n is 0 or 1, and reactive sources thereof.

18. Then composition of claim 17 wherein the carboxylic reagent is a reactive source of (IV) wherein the reactive source comprises a compound of the general formula

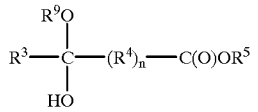

(V)

wherein each of $R^3$ and $R^5$ and each $R^9$ is independently H or hydrocarbyl group, $R^4$ is a divalent hydrocarbylene group, and n is 0 or 1.

19. The composition of claim 18 wherein each of $R^5$ and $R^9$ is independently, lower alkyl, $R^3$ is H, and n=0.

20. The composition of claim 15 wherein the acylated amine dispersant is a hydrocarbyl substituted succinic derivative.

21. The composition of claim 20 wherein the hydrocarbyl substituted succinic derivative is the reaction product of a polyolefin substituted succinic anhydride reacted with a polyalkylene polyamine.

22. The composition of claim 21 wherein the polyolefin substituted succinic anhydride is the reaction product of maleic anhydride and a polyolefin selected from the group consisting of polypropylene and polybutene.

23. The composition of claim 22 wherein the reaction product is obtained by reacting the polyolefin with maleic anhydride in the presence of chlorine.

24. The composition of claim 22 wherein the reaction product is obtained by direct thermal reaction of the polyolefin with maleic anhydride.

25. In an additive concentrate for preparing lubricants, said additive concentrate comprising at least one hydrocarbyl group substituted ashless dispersant and (A) at least one viscosity improver selected from the group consisting of (1) polyacrylate ester copolymers optionally containing nitrogen containing groups, containing from 2 to about 30 carbon atoms in the ester group and having $M_n$ ranging from about 10,000 to about 150,000; and (2) esterified carboxy-containing interpolymers optionally neutralized with an amine, having RSV ranging from about 0.05 to about 0.35, before esterification, said interpolymers derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms; the improvement wherein at least 50% by weight of the ashless dispersant is (B) a hydrocarbyl group substituted ashless dispersant wherein the hydrocarbyl group has $M_n$ ranging from about 200 to about 800, and the weight ratio of (A):(B) ranges from about 3:1 to about 1:3.

26. A method for improving the compatibility of an additive concentrate useful for preparing lubricants, said concentrate comprising a hydrocarbyl group substituted ashless dispersant and (A) at least one viscosity improver selected from the group consisting of (1) polyacrylate ester copolymers optionally containing nitrogen containing groups, containing from 2 to about 30 carbon atoms in the ester group and having $M_n$ ranging from about 10,000 to about 150,000; and (2) esterified carboxy-containing interpolymers optionally neutralized with an amine, having RSV ranging from about 0.05 to about 0.35, before esterification, said interpolymers derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms; and at least one hydrocarbyl group substituted ashless dispersant, wherein said method comprises employing at least 50% by weight of the ashless dispersant as (B) a hydrocarbyl group substituted ashless dispersant wherein the hydrocarbyl group has $M_n$ ranging from about 200 to about 800, and the weight ratio of (A):(B) ranges from about 3:1 to about 1:3.

27. A homogeneous additive concentrate useful for preparing lubricants, said concentrate prepared by mixing (A) at least one viscosity improver selected from the group consisting of (1) polyacrylate ester copolymers optionally containing nitrogen containing groups, containing from 2 to about 30 carbon atoms in the ester group and having $M_n$ ranging from about 10,000 to about 150,000; and (2) esterified carboxy-containing interpolymers optionally neutralized with an amine, having RSV ranging from about 0.05 to about 0.35, before esterification, said interpolymers derived from at least two monomers, one of said monomers being at least one of an aliphatic olefin containing from 2 to about 30 carbon atoms and a vinyl aromatic monomer and the other of said monomers being at least one alpha, beta-unsaturated acylating agent, characterized by the presence within the polymeric structure of ester groups having from 2 to about 30 carbon atoms; and at least one hydrocarbyl group substituted ashless dispersant, wherein at least 50% by weight of the ashless dispersant comprises (B) a hydrocarbyl group substituted ashless dispersant derived from a polyolefin having $M_n$ ranging from about 200 to about 800, and the weight ratio of (A):(B) ranges from about 3:1 to about 1:3.

28. A lubricating oil composition comprising a major amount of an oil of lubricating viscosity and a minor amount of the composition of claim 1.

* * * * *